US005601469A

United States Patent [19]

Yang

[11] Patent Number: 5,601,469

[45] Date of Patent: Feb. 11, 1997

[54] FASTENING DEVICE FOR CLOTH DOLLS AND DECORATIVE ARTICLES

[76] Inventor: Chen C. Yang, 8F-3, No. 321, Fu Hsing S. Road, Sec. 1, Taipei, Taiwan

[21] Appl. No.: 370,892

[22] Filed: Jan. 10, 1995

[51] Int. Cl.[6] ..... A63H 3/00

[52] U.S. Cl. ..... 446/73; 446/369; 446/390; 411/339

[58] Field of Search ..... 411/918, 339, 411/338, 508, 509, 510, 907, 908; 446/390, 73, 369

[56] References Cited

U.S. PATENT DOCUMENTS

| | | | |
|---|---|---|---|
| 1,890,348 | 12/1932 | Weatherhead | 411/339 |
| 2,174,521 | 10/1939 | Lancaster | 411/339 |
| 3,831,398 | 8/1974 | Davis | 411/508 |
| 4,035,874 | 7/1977 | Lilgendahl | 411/339 |
| 4,277,910 | 7/1981 | Kramer | 446/390 |
| 4,672,719 | 6/1987 | Scott | 411/510 |
| 5,435,679 | 7/1995 | Barry | 411/339 |

*Primary Examiner*—Flemming Saether
*Attorney, Agent, or Firm*—W. Wayne Liauh

[57] ABSTRACT

A fastening device for cloth dolls and decorative articles comprises a fastening assembly and a button ring. The fastening assembly has a pin head portion with a relatively large diameter. There is a pin hole formed axially in the pin head portion. A fastening portion is formed behind the pin head portion. There is an annular fastening groove formed on the fastening portion. The fastening assembly runs through a through hole disposed on the cloth doll's skin. A button ring is used to engage with the fastening groove, thus to firmly secure the fastening assembly on the cloth doll. The decorative article has a protrusive pin disposed at the corresponding position of the pin hole on the cloth doll. Thereby, the decorative article can be movably fastened on the cloth doll.

2 Claims, 3 Drawing Sheets

FASTENING DEVICE FOR CLOTH DOLLS AND DECORATIVE ARTICLES

BACKGROUND OF THE INVENTION

A cloth doll is a toy usually mapping the appearance of an animal or another character. A conventional cloth doll provides neither versatility nor utilization. Therefore, after a short while, it is usually abandoned because of its lack of usefulness or lost novelty.

SUMMARY OF THE INVENTION

The present invention relates to a new fastening device for cloth dolls and decorative articles. One or more fastening devices are disposed on the skin of the cloth doll. The fastening device comprises a fastening assembly and a button ring. The fastening assembly has a pin head portion at the front end with a relatively large diameter. A pin hole is formed axially at the front end. There is a fastening portion behind the pin head portion. The fastening assembly is fixed onto the cloth doll by having the fastening portion run through a pre-set through hole on the skin of the cloth doll, then having a button ring engage with a fastening groove to firmly secure the fastening assembly onto the cloth doll. Pre-set pins on a decorative article can then be engaged with the pin hole of the fastening assembly.

The object of the present invention is to provide a flexible fastening device for fastening a decorative article onto a cloth doll to facilitate assembly or breakup such that the decorative article and the cloth doll can be separated and used independently when desired.

DETAILED DESCRIPTION

Figure 3:
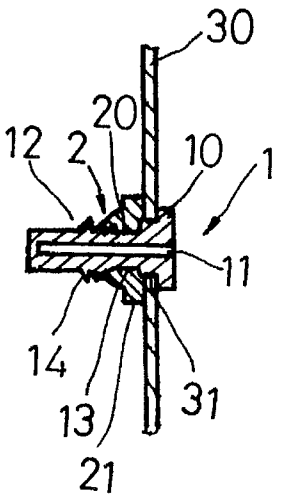
FIG. 3 is a cross section view of a fastening device of the present invention (after being installed on the skin of a cloth doll).
Figure 1:
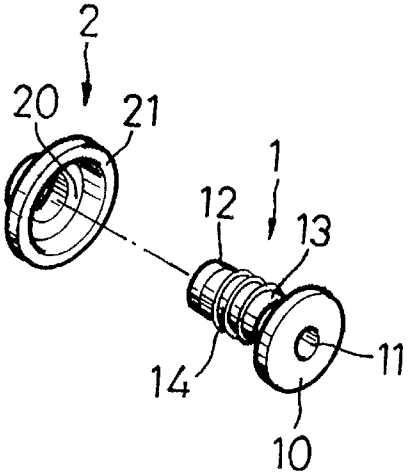
FIG. 1 is an exploded view of a fastening device of the present invention.
Figure 4:
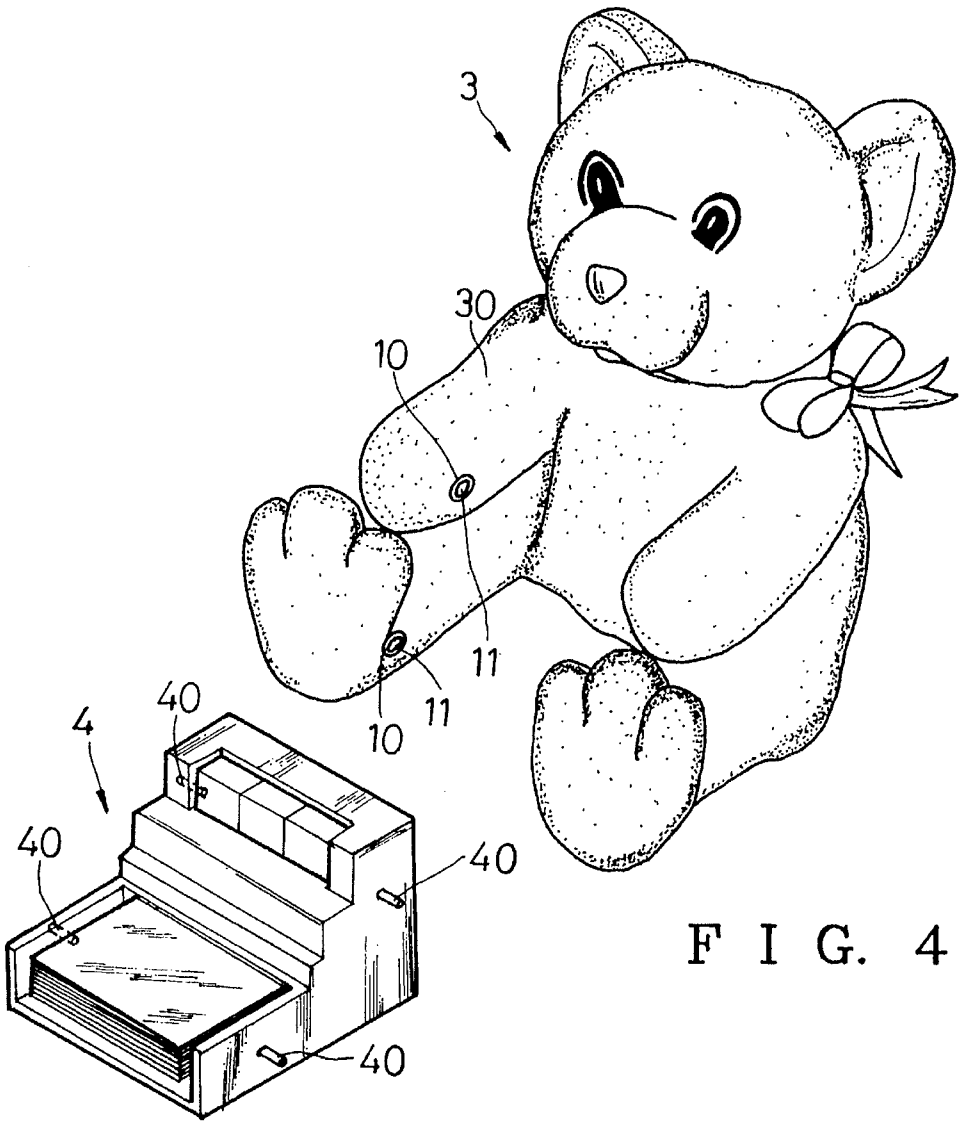
FIG. 4 is a fragmentary perspective view of a fastening device of the present invention applying to a cloth doll and a decorative article before assembly.

Referring to FIGS. 1 and 3, the present invention comprises a fastening assembly (1) and a button ring (2). Fastening assembly (1) is generally formed in a nail shape cylindrical stud having different diameters at different axial locations. The front end of the fastening assembly forms a pin head portion (10) with a larger diameter. A pin hole (11) is formed axially in the fastening assembly and runs through pin head portion (10). The rear end of pin hole (11) can either run through the rear end of fastening assembly (1) (not shown in the drawings), or stop short from the rear end of fastening assembly (1) (referring to FIG. 3). A fastening portion (12), which has a smaller diameter, is formed behind the pin head portion (10). An annular and concave fastening groove (13) is formed on fastening portion (12) and close to the pin head portion. One or more annular inverse teeth (14) are formed around the fastening portion and behind the fastening groove (13).

Button ring (2) is generally formed in an annular and hollow shape with a fastening hole (20) in the center. The internal diameter of fastening hole (20) is the same as the external diameter of fastening groove (13). An annular rim (21), which has a larger diameter, is formed in front of the fastening hole (20).

Figure 2:
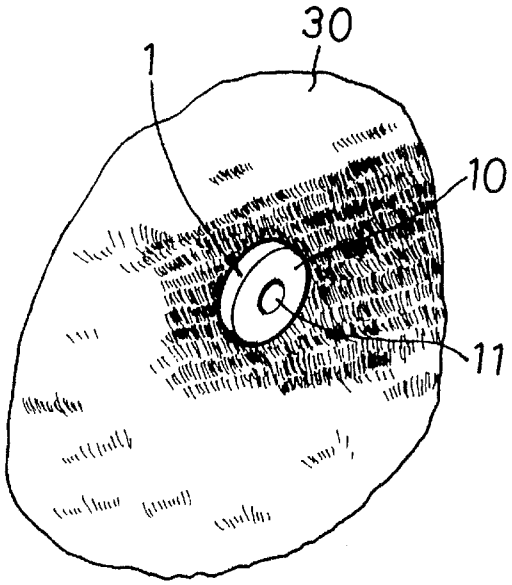
FIG. 2 is a fragmentary perspective view of a fastening device of the present invention (after being installed on the skin of a cloth doll).
Figure 5:
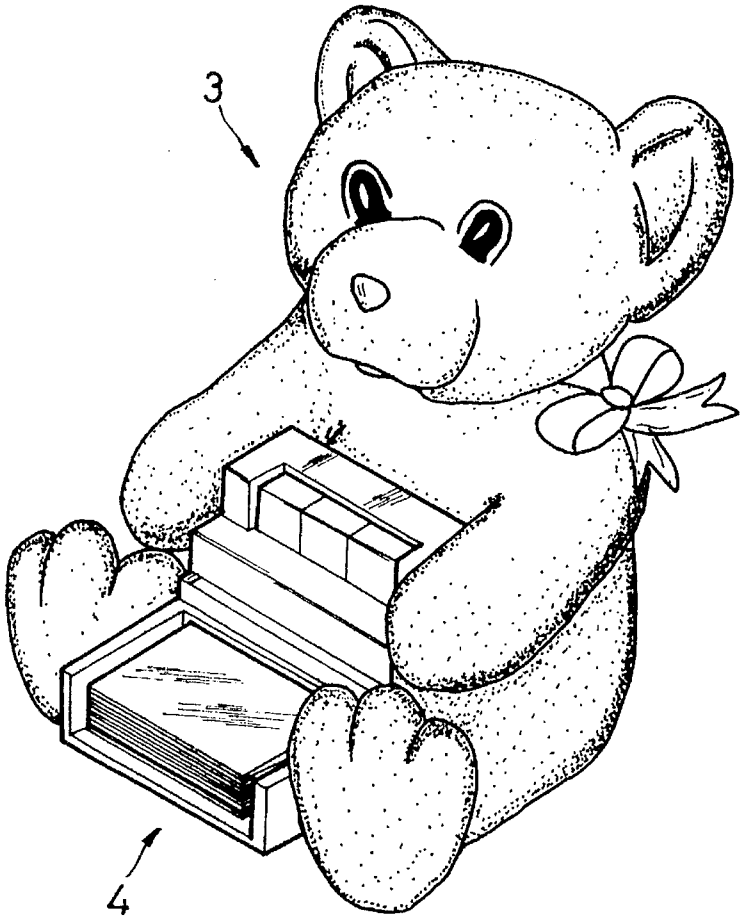
FIG. 5 is a fragmentary perspective view of a fastening device of the present invention applying to a cloth doll and a decorative article after assembly.

FIGS. 2 and 3 refer to the installation of the present invention. A pre-set through-hole (31) is firstly disposed on the skin (30) of the cloth doll. Then, fastening portion (12) of fastening assembly (1) is run through through-hole (31) and causing fastening portion (12) to be disposed inside of doll skin (30), and pin head portion (10) to be disposed outside of doll skin (30). Button ring (2) is then fastened into fastening portion (12) from the rear end and forced into fastening portion (12) from the rear end into fastening groove (13), thus making pin head portion (10) firmly engaged on the outside surface of the cloth doll. On the decorative article (4), there are four protrusive pins (40) being disposed at the corresponding locations of pin holes on the pin head portion (10) of the fastening devices. The outside diameter of protrusive pin (40) is the same as the inside diameter of pin hole (11). Thereby, protrusive pin (40) can be inserted into pin hole (11), making cloth doll (3) engage with decorative article (4) (as shown in FIG. 5).

There is no limitation on the type of cloth doll or decorative article that the present invention applies. There is also no limitation on the number of fastening assemblies (1), button rings (2), or protrusive pins (40) to be used. It can be of one, two, three, or four sets. The number and disposing locations depend on the actual requirements.

Although the present embodiment has the pin hole (11) disposing on the cloth doll and having the pin (40) disposing on the decorative article, it can also be made the other way around, i.e. to have the pin hole disposing on the decorative article and to have the pin disposing on the cloth doll (not shown in the drawings). Either way of arrangement can achieve the object of the present invention.

By applying the present invention, a decorative article can be fastened onto a cloth doll to increase the versatility and amusement effect. The decorative article can be a calendar set, a stationery set, etc. which would further increase its usefulness. Furthermore, the present invention, by using components such as pin holes and pins to fasten the cloth doll and the decorative article, is easy to assemble and dismantle, and is highly flexible.

I claim:

1. A composite cloth doll comprising:

a cloth doll having at least one arm or leg with a through-hole;

at least one fastening device fastened to said through-hole of said cloth doll, said fastening device including a fastening assembly and a button ring, said fastening assembly having a fastening portion and a pin head with a pin hole, said button ring having an annular rim and a fastening hole, and said fastening hole of said button ring being engaged with said fastening portion of said fastening assembly; and a decorative article having at least one protrusive pin, said protrusive pin is dimensioned such that it can be inserted into said pin hole of said pin head, thereby permitting said decorative article to be engaged with said cloth doll to form said composite cloth doll.

2. The composite cloth doll of claim 1 wherein said fastening portion of said fastening assembly has an annular groove and at least one inverse tooth.

* * * * *